US005435772A

United States Patent [19]

Yu

[11] Patent Number: 5,435,772

[45] Date of Patent: Jul. 25, 1995

[54] METHOD OF POLISHING A SEMICONDUCTOR SUBSTRATE

[75] Inventor: Chris C. Yu, Austin, Tex.

[73] Assignee: Motorola, Inc., Schaumburg, Ill.

[21] Appl. No.: 54,167

[22] Filed: Apr. 30, 1993

[51] Int. Cl.[6] ..... B24B 7/00

[52] U.S. Cl. ..... 451/63; 451/28; 451/41; 451/287; 451/288

[58] Field of Search ..... 451/28, 41, 63, 59, 451/287, 288

[56] References Cited

U.S. PATENT DOCUMENTS

| | | | |
|---|---|---|---|
| 3,857,123 | 12/1974 | Walsh | 51/131.4 |
| 4,313,284 | 2/1982 | Walsh | 51/131.4 |
| 4,450,652 | 5/1984 | Walsh | 51/131.4 |
| 4,511,605 | 4/1985 | McCartney | 427/246 |
| 4,613,345 | 9/1986 | Thicke et al. | 51/293 |
| 4,841,680 | 6/1989 | Hoffstein et al. | 51/283 R |
| 4,927,432 | 5/1990 | Budinger et al. | 51/298 |
| 5,020,283 | 6/1991 | Tuttle | 51/209 DL |
| 5,036,630 | 8/1991 | Kaanta et al. | 51/283 R |
| 5,081,051 | 1/1992 | Mattingly et al. | 437/10 |
| 5,173,441 | 12/1992 | Yu et al. | 437/173 |
| 5,216,843 | 6/1993 | Breivogel et al. | 51/131.1 |

OTHER PUBLICATIONS

"Research Disclosure Feb. 1991"; Disclosure #32227; Disclosed anonymously.

*Primary Examiner*—Jack W. Lavinder
*Attorney, Agent, or Firm*—George R. Meyer

[57] ABSTRACT

The present invention includes a polishing pad to improve polishing uniformity across a semiconductor substrate and a method using the polishing pad. The polishing pad has a first region that is closer to the edge of the polishing pad and a second region adjacent to the first region and further from the edge of the polishing pad. The polishing pad is configured, so that the second region is thicker or less compressible compared to the first region. The polishing pad should not require significantly changing any of the equipment. Oscillating range and possibly polishing pressure may need to be changed when one of the polishing pads of the present invention is used. Other operational parameters are not expected to be substantially different from a conventional polishing pad, although slight optimization of the other operating parameters may be needed.

6 Claims, 4 Drawing Sheets

-PRIOR ART-

-PRIOR ART-

METHOD OF POLISHING A SEMICONDUCTOR SUBSTRATE

RELATED APPLICATION

This is related to U.S. patent application Ser. No. 08/054,168, filed Apr. 30, 1993, now U.S. Pat. No. 5,329,734.

1. Field of the Invention

The present invention relates to the field of semiconductor devices, and in particular, to polishing pads used in chemical-mechanical polishing semiconductor substrates.

2. Background of the Invention

Planarization of semiconductor substrates is becoming more important as the number of layers used to form a semiconductor device increases. Nonplanar semiconductor substrates have many problems including difficulty in patterning a photoresist layer, formation of a void within a film during the film deposition, and incomplete removal of a layer during an etch process leaving residual portions of the layer, which are sometimes called "stringers." A number of planarization processes have been developed and include chemical-mechanical polishing.

FIGS. 1 and 2 include illustrations of a part of one type of a chemical-mechanical polisher that is used to polish semiconductor substrates. FIG. 1 is a cross-sectional view of a chemical-mechanical polisher 10. The polisher 10 has a platen 14 and a polishing pad 11 attached to the platen 14 with an adhesive compound (not shown). Above the polishing pad 11 are substrate holders 12, and each substrate holder 12 has a semiconductor substrate 13. The polisher 10 also includes a polishing slurry and a slurry feed, both of which are not shown. The polishing pad 11 may be made of a porous polyurethane material that has a relatively uniform thickness of about 1–2 millimeters. FIG. 2 includes a top view illustrating the relationships of motion between the polishing pad 11 and the substrates 13. During polishing, the polishing pad 11 rotates counterclockwise or clockwise, but the substrates 13 typically rotate in the same direction as the polishing pad 11. While the substrates 13 and polishing pad 11 are rotating, the substrates 13 are being oscillated back and forth across the polishing pad. The oscillating motion covers a distance called an oscillating range and is performed at an oscillating velocity. While the polishing is being performed, the polishing slurry may be recycled.

In actual use, chemical-mechanical polishing typically has nonuniform polishing rates across a semiconductor substrate surface. In many cases, the polishing rate near the edge of the semiconductor substrate is higher than the polishing rate near the center of the semiconductor substrate. The prior art has addressed the problem of nonuniform polishing by modifying the polishing pad. In the prior art, many attempts have been made to improve polishing uniformity by forming a pattern within the polishing pad. These polishing pads include forming a variety of geometric patterns.

SUMMARY OF THE INVENTION

The present invention includes a polishing pad that improves polishing uniformity across a semiconductor substrate and a method using the polishing pad. In one embodiment, the polishing pad has a first region that is closer to the edge of the polishing pad and a second region that is further from the edge of the polishing pad. The second region of the polishing pad is thicker or less compressible than the first region. The polishing pad may be used in chemical-mechanical polishing without having to substantially change the equipment or the operational parameters of the polisher other than parameters related to oscillating range and possibly polishing pressure during the polishing step.

Other features and advantages of the present invention will be apparent from the accompanying drawings and from the detailed description that follows.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF EMBODIMENTS

The present invention includes a polishing pad to improve polishing uniformity across a semiconductor substrate and a method using the polishing pad. In one embodiment, the polishing pad has a first region that is closer to the edge of the polishing pad and a second region that is further from the edge of the polishing pad. The second region of the polishing pad is thicker or less compressible than the first region. The polishing pad may be used on a polisher that can polish one or more semiconductor substrates at a time. Many commercial polishers are capable of polishing one, two, five, or six wafers during the same polishing operation. Obviously, the present invention is not limited to any of one of these polishers. Equipment modifications and polishing parameters other than oscillating range and possibly polishing pressure are not substantially affected when using a polishing pad of the present invention.

Polishing Pads

Figure 1:
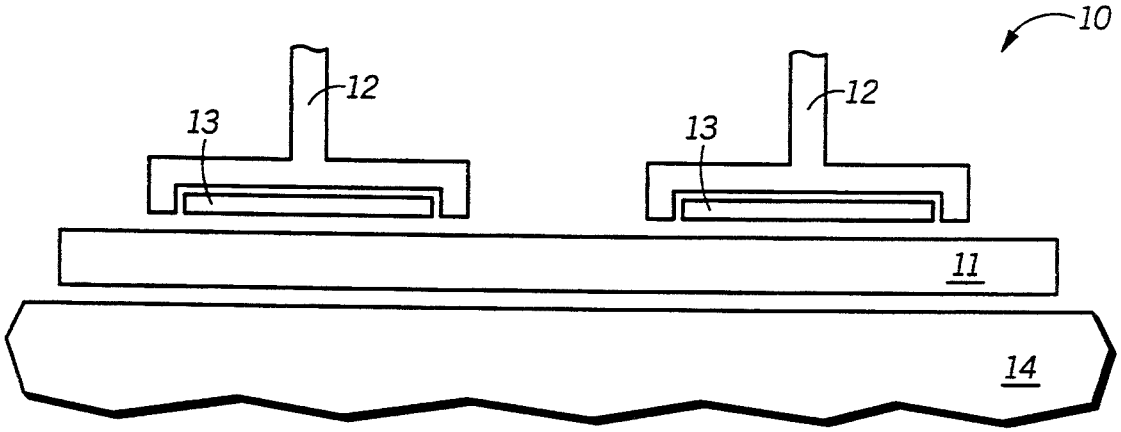
FIGS. 1 and 2 include cross-sectional and top view of a polishing pad and semiconductor substrates. (Prior art)
Figure 2:
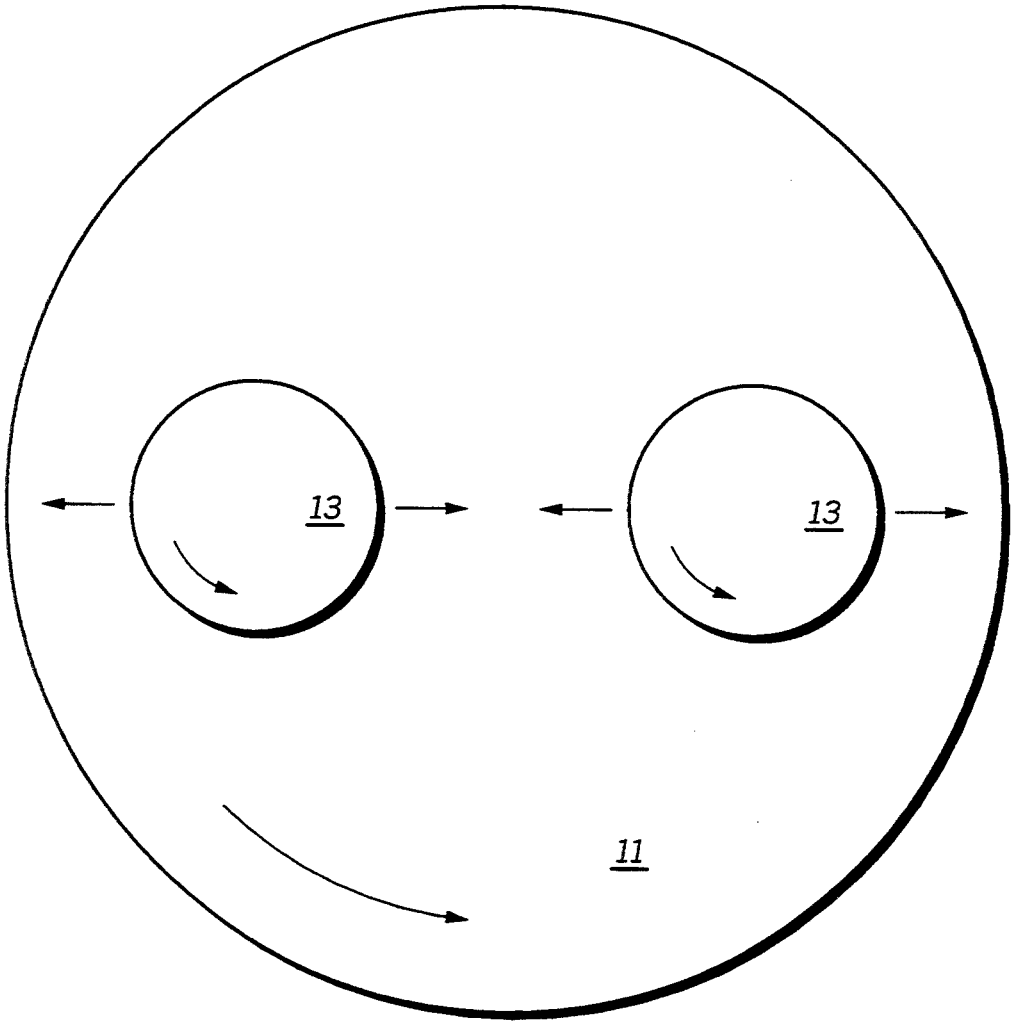
Figure 3:
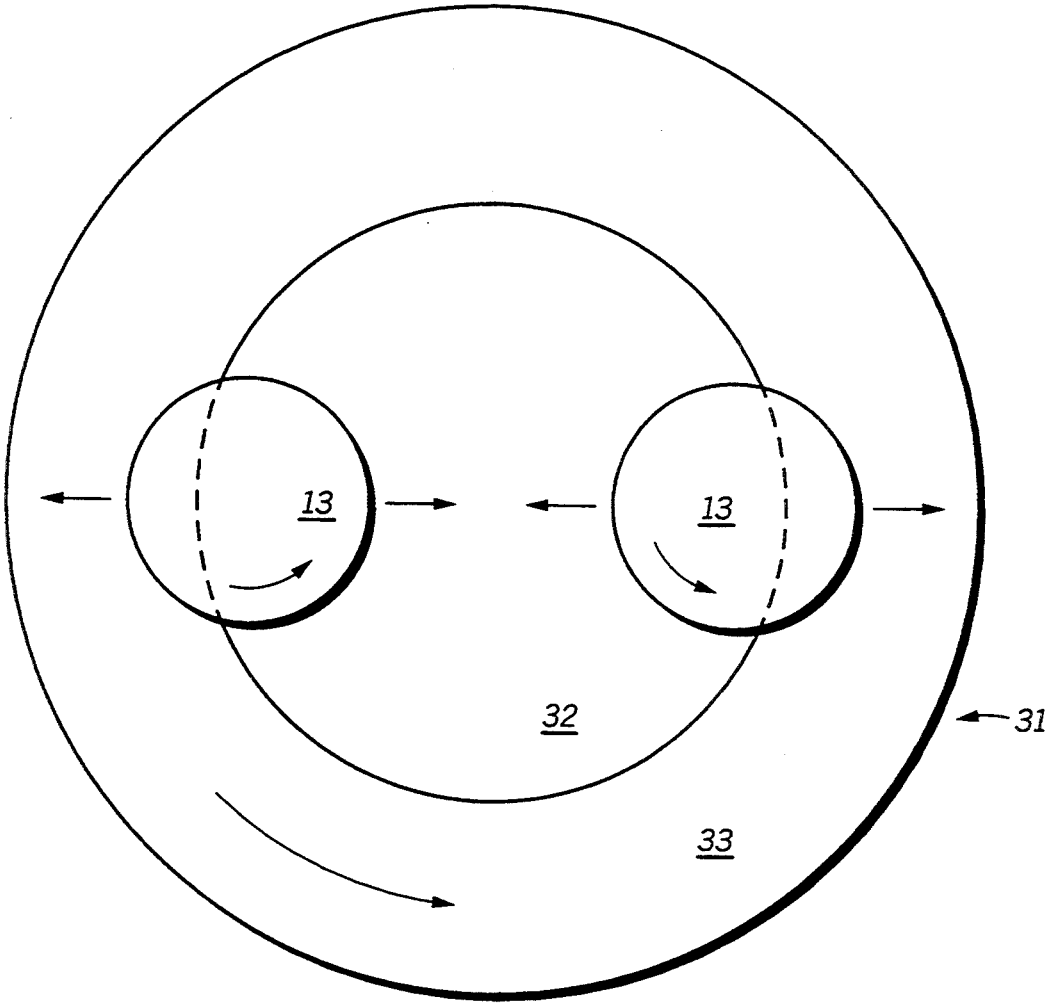
FIGS. 3–4 include cross-sectional and top views of a polishing pad and semiconductor substrates, wherein the polishing pad has a varying thickness in accordance with one embodiment of the present invention.

All of the polishing pads in FIGS. 3–10 include at least a layer of a porous polyurethane material that has an average pore size of about 100–200 microns. FIG. 3 includes an illustration of a polishing pad 31 having a varying thickness in accordance with one embodiment of the present invention. The polishing pad 31 has a first region 33 adjacent to the edge of the pad and a second region 32 further from the edge, wherein the second region 32 is thicker than the first region 33. Region 32 is about 5–20 percent thicker than the region 33, such as 10 percent. For example, region 32 may be about 2.2 millimeters thick, and region 33 may be 2.0 millimeters thick. The polishing pad 31 and substrates 13 are rotated in the same direction during the polishing, while the substrates 13 are being oscillated back and forth across a portion of the polishing pad 31. The oscillating motion is depicted by the arrows that point towards the center and edge of the polishing pad. The second region 32 has a locally higher polishing pressure during polishing compared to the local polishing pressure at the first region 33. The locally higher polishing pressure increases the local polishing rate at that point. Because the substrate 13 is rotating during the polishing, the edge region of the substrate 13 is exposed to the higher pressure only during a portion of the time, while the center region of the substrate 13 is virtually always exposed to the higher pressure. At the first region 33, the higher relative velocity between the substrate 13 and the pad 11 causes an increased polishing rate, while the lower average polishing pressure causes a decreased polishing rate. In the second region 32, the lower relative velocity between the substrate 13 and the pad 11 causes a decreased polishing rate, while the higher average polishing pressure causes an increased polishing rate. In this manner, the polishing rate of the substrate 13 may be made more uniform across the face of the substrate 13 compared to the prior art polishing pad 11.

Figure 4:
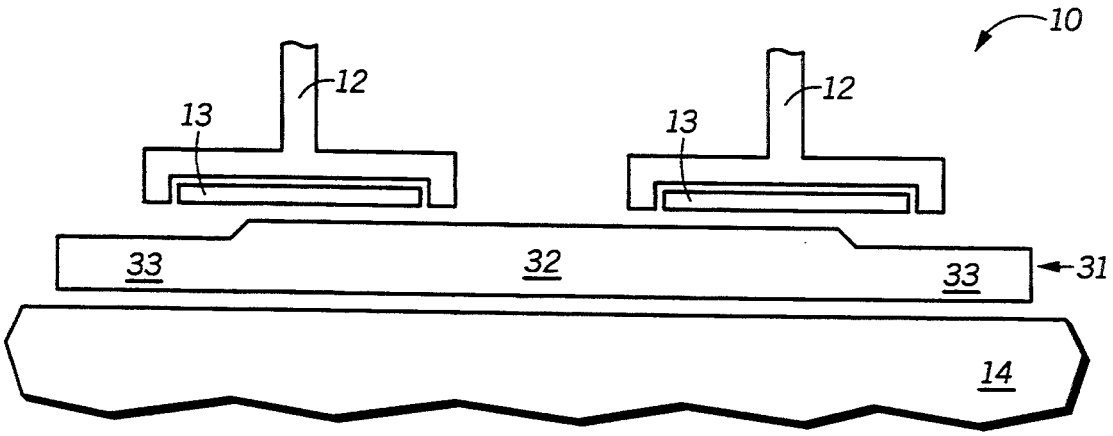

FIG. 4 includes a cross-sectional view of the polisher 10 and the polishing pad 31. The polishing pad 31 is attached to the platen 14 with an adhesive compound (not shown). The substrates 13 are held by the substrate holders 12. The center point of the substrates 13 should always be over the region 32 of the polishing pad. If the region 32 is too large, the polishing rate across the substrates 13 may not be uniform enough. The second region 32 occupies about 30–80 percent of the polishing surface area of the polishing pad 31.

Figure 5:
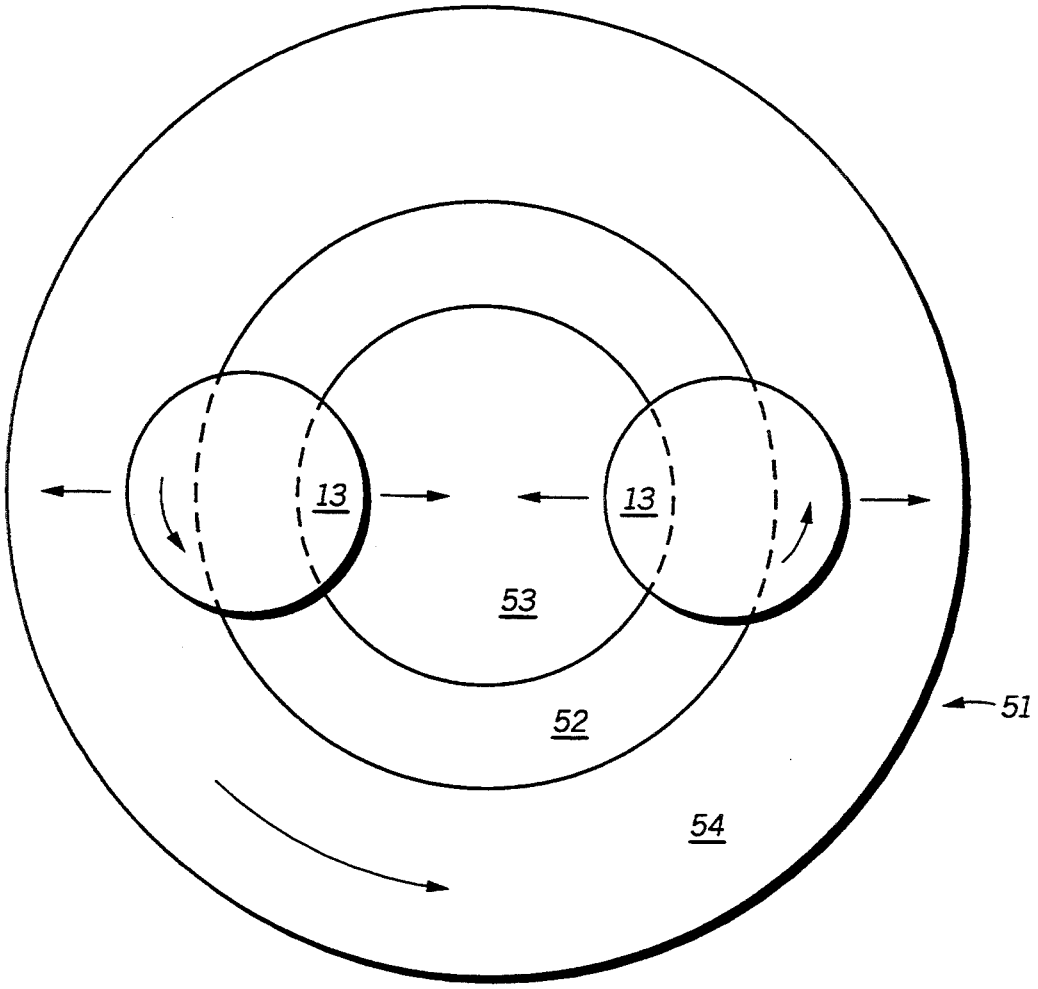
FIGS. 5–9 include cross-sectional and top views of a polishing pad and semiconductor substrates, wherein the polishing pad has a varying thickness in accordance with other embodiments of the present invention..
Figure 6:
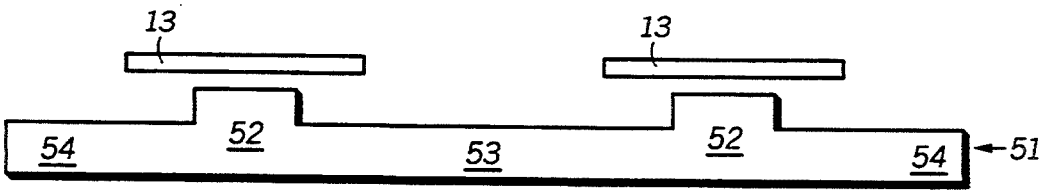

FIG. 5 illustrates another embodiment of the present invention. A polishing pad 51 has three regions including a first region 54, a second region 52, and a third region 53. The second region 52 is about 5–20 percent thicker than the first region 54. The second region 52 forms a ridge. Although FIG. 5 illustrates first region 54 and third region 53 to be about the same thickness, the first and third regions may have different thicknesses. The thickness of the second region 52 may be the same thickness as or no more than 20 percent thicker than the third region 53. FIG. 6 illustrates a cross-sectional view of polishing pad 51 and substrates 13. The width of the second region is about 20–80 percent of a dimension of the primary surface of the semiconductor substrate. If the semiconductor substrate is a wafer having a diameter of about 150 millimeters, the dimension of the primary surface is about 150 millimeters. If the width of the second region 52 is about 50 percent of the primary surface dimension of the substrate 13, then the second region 52 is about 75 millimeters wide.

Figure 7:
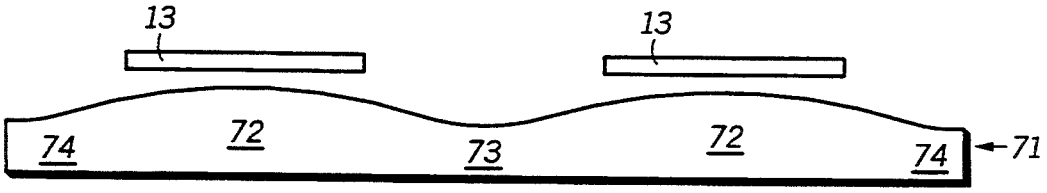

FIG. 7 illustrates still another embodiment of the present invention. FIG. 7 includes a cross-sectional view of a polishing pad 71 that is similar to polishing pad 51. Polishing pad 71 has an undulating surface. Just like polishing pad 51, polishing pad 71 has first, second, and third regions 74, 72, and 73, respectively. The surface of the polishing pad 71 does not have abrupt topography changes such as polishing pad 51. The thickness of the polishing pad 71 at its thickest point within second region 72 is about 5–20 percent thicker than the polishing pad 71 at its thinnest point within the first region 74.

Figure 8:
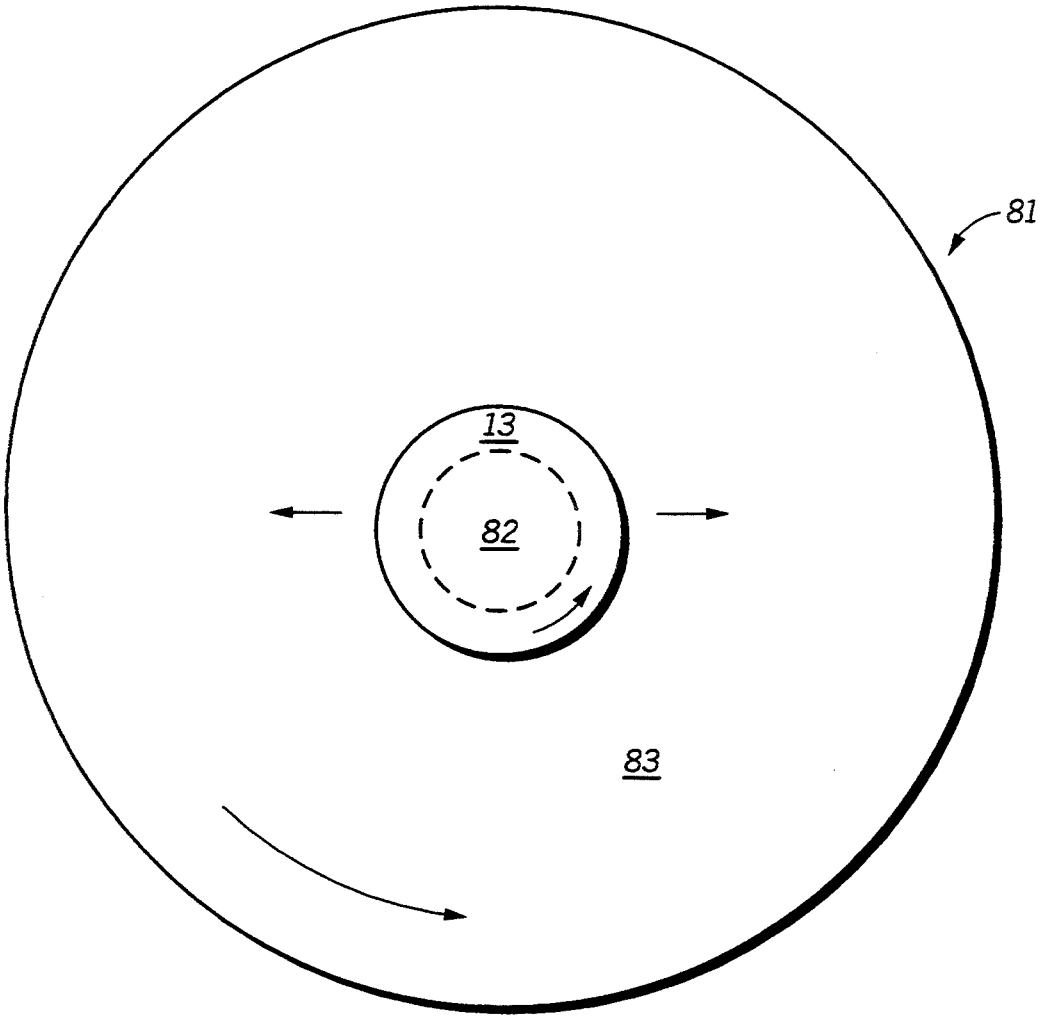
Figure 9:
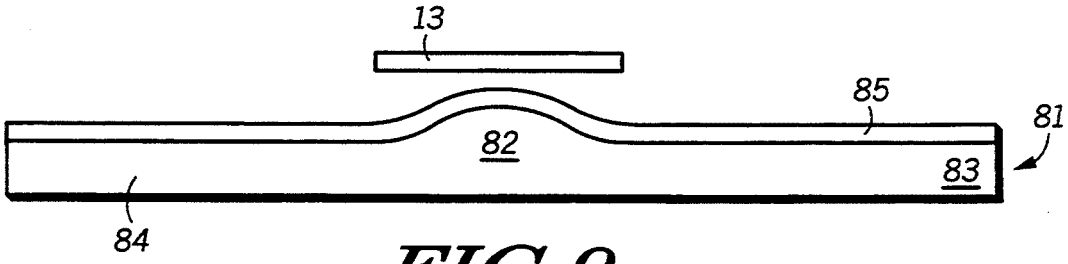

FIGS. 8 and 9 include illustrations of a polishing pad 81 having a polishing pad substrate 84 and a first layer 85. The polishing pad 81 may be used on a polisher that polishes one semiconductor substrate at a time. The polishing pad substrate 84 has a varying thickness, while the first region 85 generally has a uniform thickness and is generally conformal to the surface of the polishing pad substrate 84. The polishing pad substrate 84 may be made of polyester or a fiber glass filled epoxy resin, and the first layer 85 may be made of polyurethane. The present invention is not limited to these materials, but the polishing pad substrate 84 is typically less compressible compared to the first layer 85. The first layer 85 may be fused to the polishing pad substrate 84 or attached to the polishing pad substrate 84 with an adhesive material (not shown) or the like. The surface of the polishing pad substrate 84 does not have any abrupt topography changes. The polishing pad substrate 84 has a first region 83 and second region 82. The thickness of the polishing pad 81 at its thickest point within the second region 82 is about 5–20 percent thicker than the polishing pad 81 at its thinnest point within the first region 83.

Figure 10:
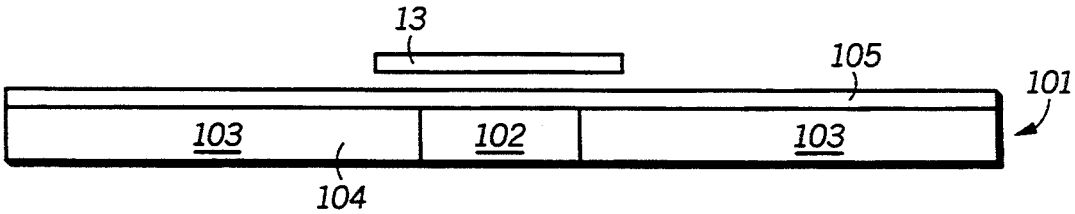
FIG. 10 include cross-sectional and top views of a polishing pad and semiconductor substrates, wherein the polishing pad has a varying compressibility in accordance with one embodiment of the present invention.

FIG. 10 includes an illustration of a polishing pad 101 and a semiconductor substrate 13. The polishing pad 101 includes a first layer 105 and a polishing pad substrate 104. The polishing pad substrate has a first region 103 and a second region 102. The first region 103 is closer to the edge of the polishing pad compared to the second region 102. The polishing pad substrate 104 is configured such that the second region 102 is less compressible than the first region 103. By less compressible, it is meant that the first region 103 requires less pressure to compress the polishing pad 101 the same distance compared the second region 102. In other words, the second region 102 is less elastic, harder, or firmer compared to the first region 103. Polyurethane is generally more compressible (more elastic, softer, or less firm) than polyester. Therefore, the first layer 105 and the first region 103 may include polyurethane, and the second region 102 may include polyester. The present invention is not limited to these materials. The compressibility of the first layer 105 and the second region 102 is less than the compressibility of the first layer 105 and the first region 103.

Manufacturing the Polishing Pads

The manufacturing of any the polishing pads is not expected to be difficult and may be performed in different manners. One or more portions of the polishing pad 11 may be removed to take form of polishing pads 31, 51, or 71. The removal may be performed by machine or abrading the surface. With machining, laser ablation may be used in one or more passes along the edge of the polishing pad to make the polishing pad thinner at its outer region. The polishing pad 11 may also be altered with an abrading tool. The abrading tool would have an abrasive compound that would remove part of the polishing pad when the tool comes in contact with the polishing pad. The methods listed above for forming the polyurethane pad are illustrative and are not to be considered limiting.

The polishing pad 81 has a polishing pad substrate 84 and a first layer 85. The polishing pad substrate 84 may be formed in a manner similar to the forming the first and second regions of the polishing pads 31, 51, or 71. As previously mentioned, the first layer 85 may be fused or attached to the polishing pad substrate 84. The polishing pad 101 may be formed from three separate pieces. The first region 103 may be piece of polyurethane material that has donut-like shape, and the second region 102 may be a disk of polyester. The first layer 105 may be fused or attached to both the first and second regions in a manner similar to polishing pad 81.

Polishing with the Polishing Pads

The polishing pads of the present invention may be used in virtually any application of chemical-mechanical polishing of semiconductor substrates. No equipment modifications should be required. Many of the operating parameters when using any one of the polishing pads should be similar to the operating parameters using a conventional polishing pad. Any one of the polishing pads illustrated in FIGS. 3–10 is attached to the platen 14 of the polisher 10 similar to a conventional polishing pad. The substrate holders 12 and the substrates 13 do not need to be treated or modified. The slurry composition, platen rotational velocity, and substrate rotational velocity are all expected to be within the normal operating parameters of a polisher that would have a conventional polishing pad. The oscillating range and polishing pressure may be more than what is typically used in the prior art. Slight adjustment to other operating parameters may be needed to optimize polishing performance. During polishing, the semiconductor substrates 13 are pressed against the polishing pad causing the polishing pad to be compressed. Referring to FIG. 6, at least a part of both semiconductor substrates 13 actually contacts the regions 52–54 some time during polishing.

The oscillating motion includes an oscillating range and an oscillating velocity. The oscillating range depends on a dimension of the primary surface of the substrate to be polished and a dimension of the second region of the polishing pad and the size of the semiconductor substrate. Typically, a semiconductor substrate oscillates in either direction no more than about 40 percent of the dimension of the primary surface. The oscillating range is typically a distance that is no more than 80 percent of a dimension of the primary surface of the semiconductor substrate. A limitation on the oscillating range is that the center point of the semiconductor substrate should always overlie the second region of the polishing pad during the polishing step. Another limitation on the oscillating range is that the edge of the semiconductor substrate should not extend beyond the edge of the polishing pad during polishing. The semiconductor substrate should be moved so that the outermost point of the semiconductor substrate lines up with the outermost point of the second region of the polishing pad some time during the polishing step. The reference point for "outermost" is the center of the polishing pad. Therefore, the outermost point of the semiconductor substrate is that point which is furthest from the center of the polishing pad, and the outermost point of the second region is that point which is furthest from the center of the polishing pad. In most applications, the oscillating range is a distance that is in a range of 5–50 percent of the dimension of the primary surface of the semiconductor substrate.

For example, assume that the semiconductor substrate is a wafer having a diameter of about 150 millimeters and that the polishing pad of FIGS. 5 and 6 is used. In a first case, assume that the width of the region 52 is about 33 percent of the diameter of the wafer or about 50 millimeters. When wafer would be centered over region 52 similar to FIG. 6, the semiconductor substrate extends about 50 millimeters beyond each edge of the region 52. Therefore, the semiconductor substrates 13 oscillate about 25 millimeters to the right and about 25 millimeters to the left. The oscillating range is about 50 millimeters. If the oscillating range in this case is reduced, the outermost point of the wafer does not line up the outermost point of the region 52. If the oscillating range in this case is increased, the center point of the wafer does not overlie the region 52 during at least some portion of the polishing step.

In a second case, assume that the width of region 52 is about 80 percent of the diameter of the wafer or about 120 millimeters. The semiconductor substrates 13 are oscillated at least about 15 millimeters in each direction, so that the outermost point of the substrates 13 line up with the outermost portion of region 52 during the polishing step. The oscillating range is at least about 30 millimeters. The semiconductor substrates 13 are oscillated no more than about 60 millimeters in each direction, so that the center point of the wafer always overlies region 52 during the polishing step. The oscillating range is no more than about 120 millimeters. In this case, the semiconductor substrates 13 are oscillated in a range of about 15–60 millimeters in each direction. The oscillating range is about 30–120 millimeters. The oscillating velocity is in a range of about 1–10 millimeters per second for either of the cases described.

The polishing pad of FIG. 10 may allow a higher polishing pressure to be used. Polishing pressure is typically no more than about 48 kilopascals (about 7.0 pounds per square inch) when polishing with a conventional polishing pad. In order to fully utilize the compressibility difference between the regions 102 and 103 in FIG. 10, a polishing pressure higher than about 52 kilopascals (about 7.5 pounds per square inch) may be used during the polishing step. Although an upper limit to the polishing pressure is not known, a polishing pressure higher than about 83 kilopascals (about 12.0 pounds per square inch) may significantly increase the risk that the substrate 13 might break during polishing. Therefore, the polishing pressure should not exceed about 83 kilopascals (about 12.0 pounds per square inch).

Benefits

The present invention includes many benefits. The polishing pads of the present invention may be used in many commercial chemical-mechanical polishers without any significant changes to the equipment. The polishing parameters other than oscillating range and polishing pressure are not expected to be significantly changed. Although the oscillating range and polishing pressure may change, little or no adjustment to the other processing parameters may be necessary in order to achieve optimal polishing of the semiconductor substrate.

The polishing pads of the present invention are expected to have more uniform polishing characteristics. Many of the prior art polishing pads have geometric patterns that are supposed to improve polishing uniformity. Contrary to the beliefs of the prior art, I believe that those pads with their geometric patterns actually contribute to polishing nonuniformity. The geometric patterns in many of the pads are expected to further increase the polishing rate of the semiconductor substrate at points on the semiconductor substrate that are closer to the edge of the polishing pad. It should be kept in mind that the platen and semiconductor substrates typically rotate in the same direction. Therefore, the relative velocity of the semiconductor substrate to the polishing pad is the highest at the edge of the semiconductor substrate when it is the closest to the edge of the polishing pad. Unlike the prior art, the present invention allows the local polishing pressure to be increased over the center of the semiconductor substrate. The higher pressure occurs at points where the polishing pad is thicker or less compressible compared to other points of the polishing pad.

The present invention is not limited by the embodiments or materials listed herein. The polishing pads of the present invention may be used on a polisher capable of polishing any number of semiconductor substrates during the same polishing step.

In the foregoing specification, the invention has been described with reference to specific embodiments thereof. It will, however, be evident that various modifications and changes can be made thereto without departing from the broader spirit or scope of the invention as set forth in the appended claims. The specification and drawings are, accordingly, to be regarded in an illustrative rather than a restrictive sense.

What is claimed is:

1. A method of polishing a semiconductor substrate having a center point, an edge point, and a primary surface having a primary surface dimension, wherein the method comprises the steps of:

placing the semiconductor substrate in a polisher; and polishing the semiconductor substrate with a polishing pad, wherein:

the polishing pad includes:

an edge;

a first region that has a first thickness and is adjacent to the edge;

a second region that has a second thickness, wherein:

the second region is adjacent to the first region, the second region is further from the edge compared to the first region; and the second thickness is thicker than the first thickness;

the steps of polishing further comprising: rotating the polishing pad; and rotating the substrate about its center point so that portions of the substrate come into contact with both the first and second regions of the pad while the center point of the substrate overlies the second region of the polishing pad to improve the polishing uniformity across the substrate.

2. The method of claim 1, wherein the polishing step includes oscillating the semiconductor substrate across a portion of the polishing pad, wherein the oscillating:

covers an oscillating range that is a distance in a range of about 5–50 percent of the primary surface dimension; and is performed at an oscillating velocity that is in a range of about 1–10 millimeters per second.

3. The method of claim 1, wherein the polishing step is performed using a polishing pressure in a range of about 7.5–12.0 pounds per square inch.

4. A method of polishing a semiconductor substrate having a center point, an edge point, and a primary surface having a primary surface dimension, wherein the method comprises the steps of:

placing the semiconductor substrate in a polisher; and polishing the semiconductor substrate with a polishing pad, wherein:

the polishing pad includes:

an edge;

a first region having a first compressibility and that is adjacent to the edge;

a second region:

that is adjacent to the first region;

that is further from the edge compared to the first region; and has a second compressibility, wherein the second compressibility is less than the first compressibility;

the steps of polishing further comprising: rotating the polishing pad; and rotating the substrate about its center point so that portions of the substrate come into contact with both the first and second regions of the pad while the center point of the substrate overlies the second region of the polishing pad to improve the polishing uniformity across the substrate.

5. The method of claim 4, wherein the polishing step includes oscillating the semiconductor substrate across a portion of the polishing pad, wherein the oscillating:

covers an oscillating range that is a distance in a range of about 5–50 percent of the primary surface dimension; and is performed at an oscillating velocity that is in a range of about 1–10 millimeters per second.

6. The method of claim 4, wherein the polishing step is performed using a polishing pressure in a range of about 7.5–12.0 pounds per square inch.

* * * * *